US010550698B2

(12) United States Patent
Inomata et al.

(10) Patent No.: US 10,550,698 B2
(45) Date of Patent: Feb. 4, 2020

(54) TURBINE

(71) Applicant: Toshiba Energy Systems & Solutions Corporation, Kawasaki-shi (JP)

(72) Inventors: Asako Inomata, Yokohama (JP); Iwataro Sato, Hiratsuka (JP); Hideyuki Maeda, Yokohama (JP); Satoru Sekine, Yokohama (JP); Kazutaka Tsuruta, Yokohama (JP); Takeo Suga, Yokohama (JP)

(73) Assignee: Toshiba Energy Systems & Solutions Corporation, Kawasaki-shi (JP)

( * ) Notice: Subject to any disclaimer, the term of this patent is extended or adjusted under 35 U.S.C. 154(b) by 758 days.

(21) Appl. No.: 15/259,218

(22) Filed: Sep. 8, 2016

(65) Prior Publication Data

US 2016/0376890 A1 Dec. 29, 2016

Related U.S. Application Data

(63) Continuation of application No. PCT/JP2015/057208, filed on Mar. 11, 2015.

(51) Int. Cl.
*F01D 5/08* (2006.01)
*F01D 5/06* (2006.01)

(52) U.S. Cl.
CPC ..... *F01D 5/08* (2013.01); *F01D 5/06* (2013.01); *F01D 5/063* (2013.01); *F01D 5/081* (2013.01);
(Continued)

(58) Field of Classification Search
CPC . F01D 5/08; F01D 5/081; F01D 5/085; F01D 5/082; F01D 5/06; F01D 5/063
See application file for complete search history.

(56) References Cited

U.S. PATENT DOCUMENTS 4,456,427 A 6/1984 Evans et al.
5,413,463 A 5/1995 Chiu et al.
(Continued)

FOREIGN PATENT DOCUMENTS

JP 53-64112 A 6/1978
JP 58-10123 A 1/1983
(Continued)

OTHER PUBLICATIONS

International Search Report dated Jun. 16, 2015 in PCT/JP2015/057208.

*Primary Examiner* — Woody A Lee, Jr.
*Assistant Examiner* — Sabbir Hasan
(74) *Attorney, Agent, or Firm* — Oblon, McClelland, Maier & Neustadt, L.L.P.

(57) ABSTRACT

A turbine 10 includes: a turbine rotor having a rotor main body including a hollow part into which a cooling fluid flows, and a plurality of rotor wheels arranged in an axial direction of the rotor main body and protruding from the rotor main body. A cooling-fluid introducing passage extending from the hollow part in a direction intersecting with the axial direction of the rotor main body is formed in the rotor main body so as to allow the cooling fluid in the hollow part to flow through the cooling-fluid introducing passage and then to flow around the rotor wheel to be conducted to the working-fluid flow passage. A flow-rate control plug regulating a flow rate of the cooling fluid flowing through the cooling-fluid introducing passage is disposed in the cooling-fluid introducing passage.

9 Claims, 10 Drawing Sheets

(52) U.S. Cl.
CPC ..... *F01D 5/085* (2013.01); *F05D 2220/32* (2013.01); *F05D 2240/24* (2013.01); *F05D 2240/61* (2013.01); *F05D 2260/20* (2013.01); *F05D 2270/3062* (2013.01)

(56) References Cited

U.S. PATENT DOCUMENTS

| | | | |
|---|---|---|---|
| 2003/0147741 | A1 | 8/2003 | Coppola |
| 2004/0046326 | A1 | 3/2004 | Yuri et al. |

FOREIGN PATENT DOCUMENTS

| | | | | |
|---|---|---|---|---|
| JP | 2-81902 | A | | 3/1990 |
| JP | 5-248204 | A | | 9/1993 |
| JP | 2003-533631 | A | | 11/2003 |
| JP | 2004-100686 | A | | 4/2004 |
| JP | 2005-320875 | A | | 11/2005 |
| JP | 2005320875 | A | * | 11/2005 |
| JP | 2011-208561 | A | | 10/2011 |
| JP | 2013-19284 | A | | 1/2013 |
| JP | 2013019284 | A | * | 1/2013 |

* cited by examiner

TURBINE

CROSS-REFERENCE TO RELATED APPLICATIONS

This application is a continuation of International Application No. PCT/JP2015/057208, filed Mar. 11, 2015.

FIELD

Embodiments of the present invention relate to a turbine.

BACKGROUND

A turbine includes a turbine rotor, and a plurality of moving blades supported on the turbine rotor. By rotating the moving blades by means of a working fluid, the turbine rotor is driven. In recent years, attempts to elevate a temperature of the working fluid have been made in order to improve a turbine efficiency. With the working fluid having a higher temperature, some components are required to be made of a heat-resistant alloy.

In particular, in a part of the turbine rotor supporting the moving blades, i.e., a rotor wheel where a large stress is generated, lowering of strength caused by a high temperature is required to be restrained, as well as the heat resistance by the heat-resistant alloy is required to be ensured. There is proposed a technique for cooling the rotor wheel of the turbine rotor so as to restrain lowering of the strength of the rotor wheel.

When cooling the rotor wheel by a cooling fluid, a plurality of cooling-fluid introducing passages through which a cooling fluid flows are typically formed in the turbine rotor, and the rotor wheel is cooled by a cooling fluid having passed through the cooling-fluid introducing passages. The cooling fluid having cooled the rotor wheel merges into a working fluid for driving the moving blades. Thus, the higher a flow rate of the cooling fluid is, the greater the cooling fluid exerts an influence on a temperature of the working fluid, which lowers the turbine efficiency.

Thus, the flow rate of the cooling fluid is required to be made minimum, depending on a flow rate of the working fluid and an output taken out from the turbine rotor. However, after the cooling-fluid introducing passages have been formed in the turbine rotor, to change the flow rate of the cooling fluid is required a lot of effort and time. Namely, it is required that the turbine is disassembled to take out the turbine rotor, and then that the cooling-fluid introducing passages formed in the turbine rotor are refabricated.

DETAILED DESCRIPTION OF THE INVENTION

A turbine according to the embodiment includes: a turbine rotor having a rotor main body including a hollow part into which a cooling fluid flows, and a plurality of rotor wheels arranged in an axial direction of the rotor main body and protruding from the rotor main body; and a plurality of moving blade rows each being supported on the corresponding rotor wheel, the moving blade row being driven by a working fluid flowing through a working-fluid flow passage. Wherein a cooling-fluid introducing passage extending from the hollow part in a direction intersecting with the axial direction of the rotor main body is formed in the rotor main body so as to allow the cooling fluid in the hollow part to flow, through the cooling-fluid introducing passage and then to flow around the rotor wheel to be conducted to the working-fluid flow passage, and a flow-rate control plug regulating a flow rate of the cooling fluid flowing through the cooling-fluid introducing passage is disposed in the cooling-fluid introducing passage.

In addition, a power plant according to the embodiment includes: an oxygen producing apparatus configured to extract oxygen from air by removing nitrogen; a combustor configured to generate a combustion gas by combusting a fuel and oxygen extracted by the oxygen producing apparatus; the above-described turbine configured to be rotationally driven by the combustion gas which is generated by the combustor and is supplied to the turbine as a working fluid; a generator configured to generate power by the turbine driven in rotation; a cooler configured to cool an exhaust gas discharged from the turbine; a moisture separator configured to separate and remove moisture in the exhaust gas cooled by the cooler to regenerate the exhaust gas; a compressor configured to compress a regenerative gas regenerated by the moisture separator; and a regenerative heat exchanger configured to exchange heat between the regenerative gas compressed by the compressor and the exhaust gas flowing from the turbine toward the cooler. The regenerative gas heat-exchanged by the regenerative heat exchanger is supplied to the combustor.

According to the turbine and the power plant according to the embodiment, since the flow rate of the cooling fluid flowing through the cooling-fluid introducing passage can be regulated by the flow-rate control plug, the flow rate of the cooling fluid can be easily controlled by replacing the flow-rate control plug without refabricating the rotor.

Figure 1:
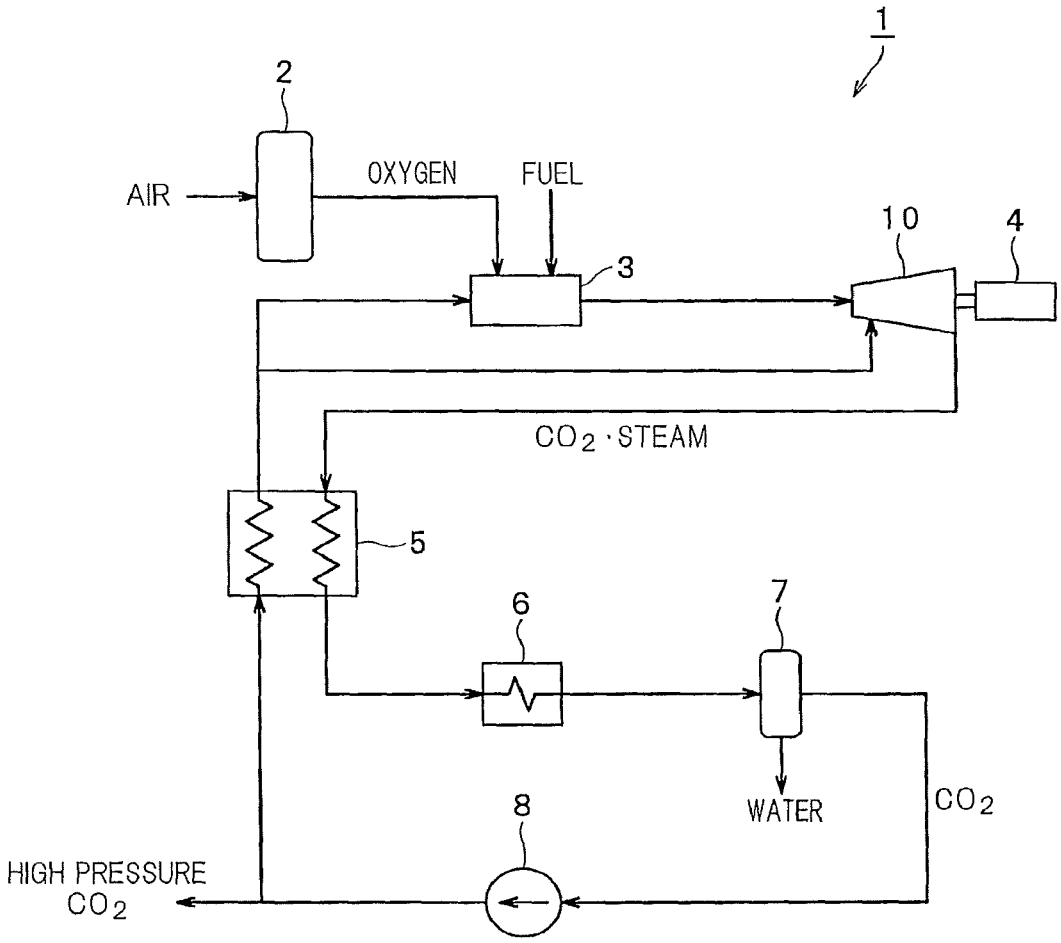
FIG. 1 is a schematic view showing an overall structure of a power plant in which a turbine according to one embodiment is installed.

An embodiment of the present invention will be described herebelow with reference to the drawings. In the drawings attached to the specification, a scale size, an aspect ratio and so on are changed and exaggerated from the actual ones, for the convenience of easiness in illustration and understanding. FIGS. 1 to 11 are views for explaining the embodiment. FIG. 1 is a schematic view showing an overall structure of a power plant 1 in which a turbine 10 according to the embodiment is installed.

The power plant 1 shown in FIG. 1 is a power plant that drives the turbine 10 by means of $CO_2$ of a high temperature and a high pressure generated by combusting a fuel with oxygen. Such a power plant can perform power generation and $CO_2$ recovery, whereby the power plant 1 has recently attracted attention as a technique for $CO_2$ emission control.

As illustrated in FIG. 1, the power plant 1 includes an oxygen producing apparatus 2 extracting oxygen from air by removing nitrogen, a combustor 3 generating a combustion gas, and the turbine 10 that is driven by the combustion gas which is generated by the combustor 3 and is supplied to the turbine 10 as a working fluid.

The combustor 3 is supplied with the oxygen extracted by the oxygen producing apparatus 2. The combustor 3 is configured to generate the combustion gas by combusting the oxygen with a fuel. The fuel used in the combustor 3 can be, for example, natural gas free of nitrogen such as methane gas. Since the air from which nitrogen is removed, that is, oxygen, is used for the combustion of the fuel, the combustion gas generated in the combustor 3 contains $CO_2$ gas and steam. Namely, components of the combustion gas are $CO_2$ (carbon dioxide) and water. Therefore, inclusion of a gas such as SOx (sulfur oxide) and NOx (nitrogen oxide) in the combustion gas can be suppressed.

The combustor 3 is configured to generate a combustion gas of a high temperature. Preferably, the combustor 3 generates a combustion gas having a temperature of, for example, 600° C. or higher. Thus, a power generation efficiency can be improved, while an amount of generated gas such as $CO_2$ can be suppressed. The combustor 3 is supplied from a regenerative heat exchanger 5, which will be described below, with a regenerative gas (specifically, $CO_2$ gas, that is, a gas containing $CO_2$ as a component) heated in the regenerative heat exchanger 5. The fuel is combusted with the supplied regenerative gas.

The combustion gas generated by the combustor 3 is supplied to the turbine 10, as a working fluid to drive the turbine 10. A generator 4 is connected to the turbine 10. By driving the turbine 10, the generator 4 generates power.

The combustion gas having worked in the turbine 10 is discharged as an exhaust gas from the turbine 10. The exhaust gas contains $CO_2$ gas and steam. Namely, components of the exhaust gas are also $CO_2$ and water. The exhaust gas is supplied to the regenerative heat exchanger 5 provided on the downstream side of the turbine 10. The regenerative heat exchanger 5 is supplied from a $CO_2$ pump (compressor) 8, which will be described below, with a regenerative gas of relatively a low temperature. Thus, the regenerative gas and the exhaust gas exchange heat with each other in the regenerative heat exchanger 5, so that the exhaust gas of relatively a high temperature is cooled.

A cooler 6 is provided on the downstream side of the regenerative heat exchanger 5. The cooler 6 is supplied with the cooled exhaust gas from the regenerative heat exchanger 5. The cooler 6 further cools the exhaust gas.

A moisture separator 7 is provided on the downstream side of the cooler 6. The moisture separator 7 is supplied with the exhaust gas cooled by the cooler 6. The moisture separator 7 separates and removes moisture in the exhaust gas. Thus, moisture is removed from the exhaust gas containing $CO_2$ and water as components, thereby regenerating the exhaust gas. Namely, the exhaust gas is regenerated to a regenerative gas that is a gas containing $CO_2$ as a component.

The $CO_2$ pump 8 is provided on the downstream side of the moisture separator 7. The $CO_2$ pump 8 is supplied with the regenerative gas regenerated by the moisture separator 7. The $CO_2$ pump 8 compresses the regenerative gas to raise the pressure of the regenerative gas.

The compressed regenerative gas is supplied to the aforementioned regenerative heat exchanger 5. As described above, in the regenerative heat exchanger 5, heat is exchanged between the regenerative gas compressed by the $CO_2$ pump 8 and the exhaust gas flowing from the turbine 10 toward the cooler 6. Thus, the regenerative gas of relatively a low temperature is heated. A part of the regenerative gas compressed by the $CO_2$ pump 8 is recovered without being supplied to the regenerative heat exchanger 5. The recovered regenerative gas is stored, or used for other purposes (e.g., used for increasing the amount of oil produced by oil-drilling).

The regenerative gas heated by the regenerative heat exchanger 5 is supplied to the combustor 3. A part of the regenerative gas is also supplied to the turbine 10 and used as a cooling medium.

In this manner, in the power plant 1 illustrated in FIG. 1, power is generated using the combustion gas containing $CO_2$ generated by combustion and water as components, and having a temperature of 600° C. or higher. A large part of $CO_2$ is circulated and reused. Thus, a volume flow rate of the working fluid can be increased, while generation of NOx or SOx which is a harmful gas can be prevented. In addition, an equipment for separating and recovering $CO_2$ from the exhaust gas is no more necessary. Further, the purity of recovered $CO_2$ can be raised, thereby allowing the recovered $CO_2$ to be used for various purposes other than power generation.

Figure 2:
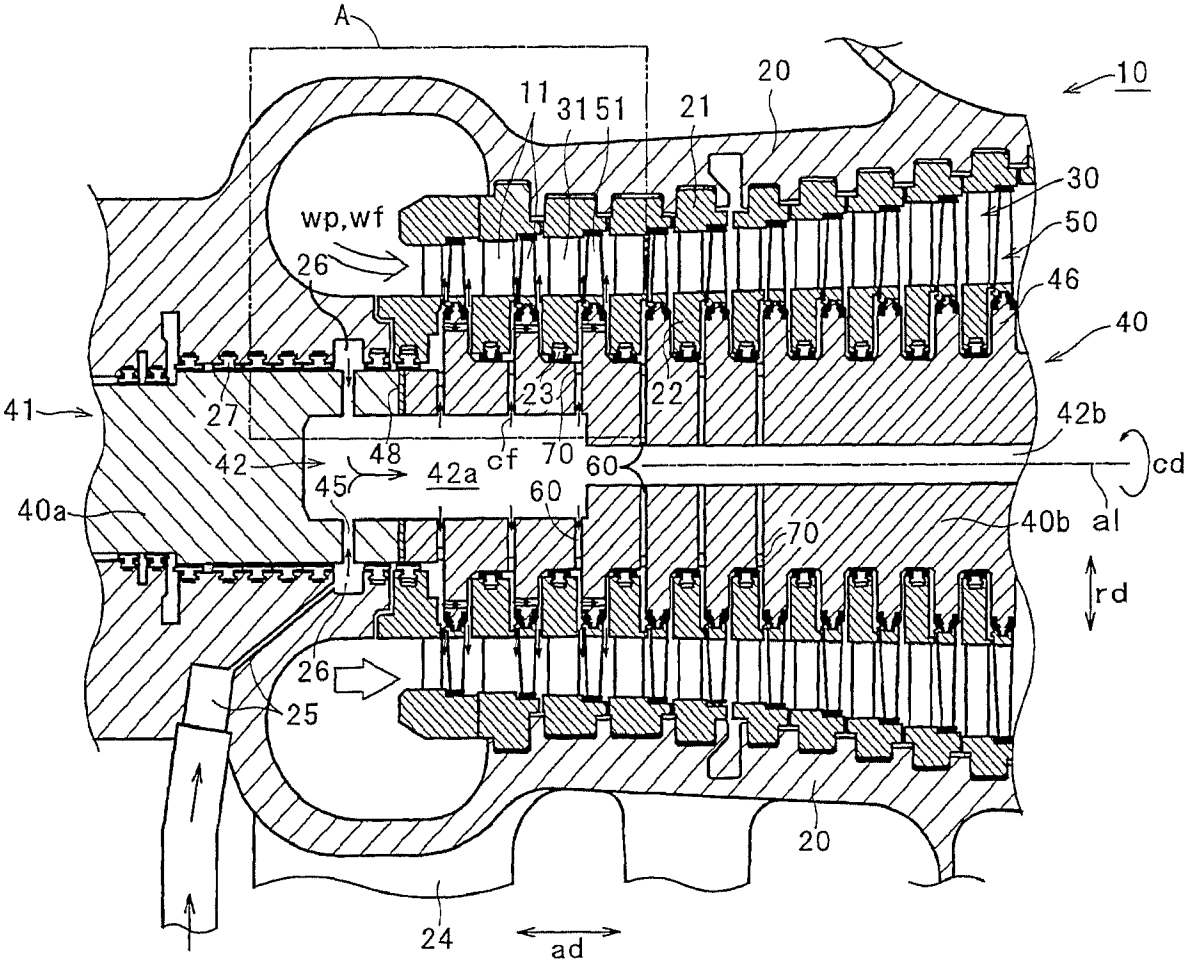
FIG. 2 is a longitudinal sectional view of the turbine shown in FIG. 1.
Figure 3:
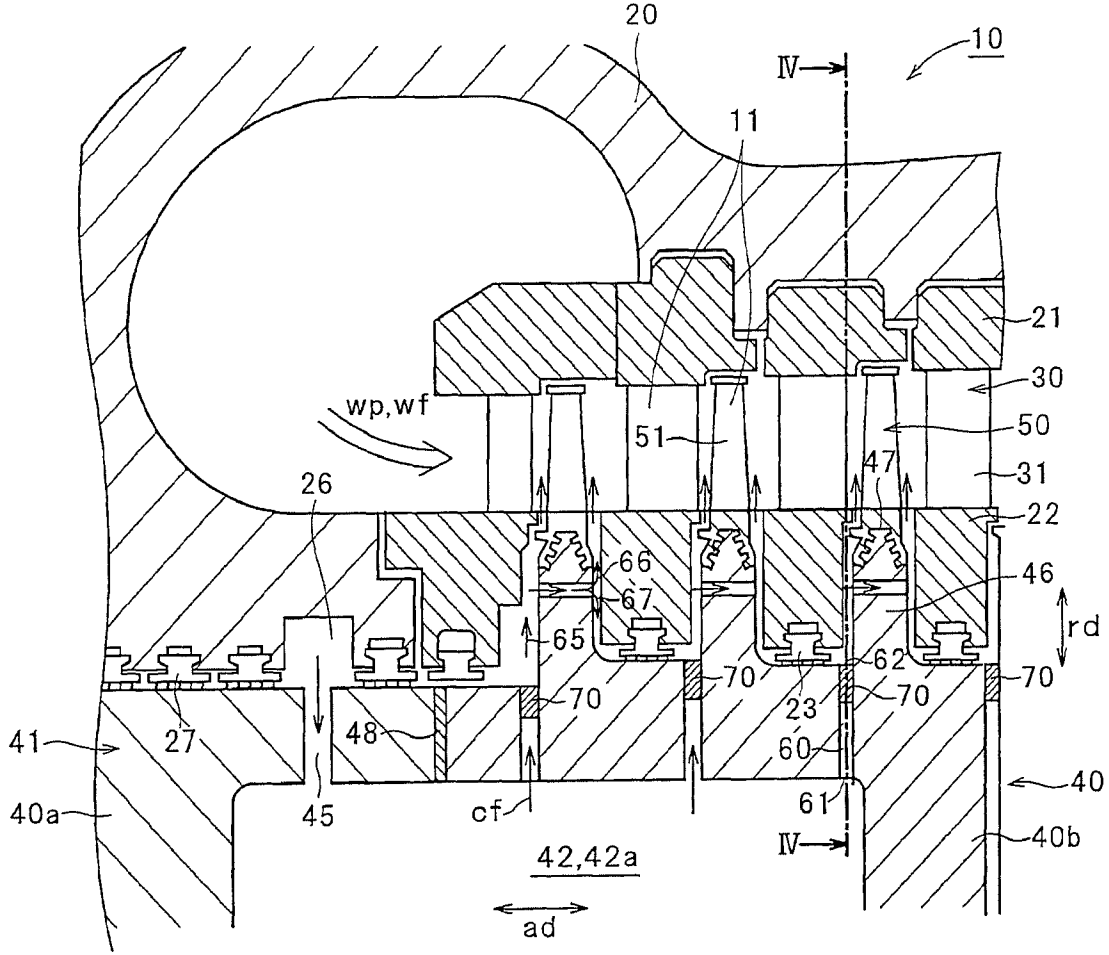
FIG. 3 is a longitudinal sectional view showing in enlargement an area A surrounded by one-dot chain lines shown in FIG. 2.

Next, the turbine 10 in this embodiment is described herebelow, with reference to FIGS. 2 and 3. FIG. 2 is a longitudinal sectional view of the turbine 10 installed in the power plant 1 shown in FIG. 1, and FIG. 3 is a longitudinal sectional view showing a part of the turbine 10 shown in FIG. 2.

As shown in FIG. 2, the turbine 10 includes a casing 20 and a turbine rotor 40 rotatably provided with respect to the casing 20. The turbine rotor 40 includes a rotor main body 41 extending along an axis al, and a plurality of rotor wheels 46 arranged around the rotor main body 41. In the description herebelow, a direction in which the axis al extends is referred to as axial direction ad, a direction perpendicular to the axial direction ad is referred to as radial direction rd, and a rotational direction about the axis al is referred to as circumferential direction cd.

The plurality of rotor wheels 46 are disposed along the axis al of the rotor main body 41 at intervals therebetween. Each rotor wheel 46 extends from the rotor main body 41 outward in the radial direction rd of the rotor main body 41 so as to support a corresponding moving blade row 50. Each moving blade row 50 includes a plurality of moving blades 51 disposed at intervals therebetween in the circumferential direction cd. As shown in FIG. 3, each moving blade 51 is inserted in and supported by a blade implantation groove 47 formed in the rotor wheel 46.

The casing 20 is provided with a plurality of stationary blade rows 30 corresponding to the plurality of moving blade rows 50. Each stationary blade row 30 includes a plurality of stationary blades 31 disposed at intervals therebetween in the circumferential direction cd. As shown in FIG. 3, each stationary blade 31 is supported at its outer circumferential end by a diaphragm outer ring 21, and is supported at its inner circumferential end by a diaphragm inner ring 22. An inner circumferential surface of the diaphragm inner ring 22, i.e., a surface facing the side of the turbine rotor 40 is provided with a labyrinth seal device 23. The labyrinth seal device 23 is configured to prevent that a working fluid wf flows downward (right side in FIG. 2) through a gap between the diaphragm inner ring 22 and the rotor main body 41 to leak therefrom.

The stationary blade rows 30 and the moving blade rows 50 are alternately disposed along the axial direction ad. One turbine stage 11 is constituted by one stationary blade row 30 and one moving blade row 50 disposed adjacent to the one stationary blade row 30 on the downstream side thereof. Thus, a plurality of the turbine stages 11 are constituted by the plurality of stationary blade rows 30 and the plurality of moving blade rows 50.

The working fluid wf flows along a working-fluid flow passage wp passing through the respective turbine stages 11. In this embodiment, the combustion gas generated in the combustor 3 is conducted as the working fluid wf from a working-fluid inlet tube 31 into a first turbine stage 11 on the most upstream side. The working fluid wf having been conducted to the first turbine stage 11 flows sequentially through the respective turbine stages 11, and works for the moving blades 51 of the respective turbine stages 11 so as to drive the turbine rotor 40 in rotation. Thereafter, the working fluid wf flows through the final turbine stage 11 on the most downstream side, and is discharged outside the turbine 10. In the example shown in FIG. 2, the working fluid wf to be conducted to the working-fluid flow passage wp is supplied from the working-fluid inlet tube 24 connected to the casing 20.

Since a large stress is generated by a centrifugal force caused by the rotation in the rotor wheels 46 supporting the moving blade rows 50, it is required to restrain lowering of strength caused by a high temperature. In this embodiment, a mechanism for cooling the rotor wheels 46 is provided on the turbine rotor 40.

To be specific, as shown in FIG. 2, the turbine rotor 40 is formed by welding each other two rotor structural members 40*a*, 40*b* that are arranged along the axial direction ad. A hollow part 42 is formed inside the two rotor structural members 40*a*, 40*b* to straddle them. A cooling fluid cf flows into the hollow part 42. In the example shown in FIG. 2, a seam 48 is formed by welding the two rotor structural members 40*a*, 40*b*. The seam 48 annularly surrounds the hollow part 42.

In this embodiment, the hollow part 42 includes a storage space 42*a* having relatively a larger diameter, and a center through-hole 42*b* having a diameter smaller than the diameter of the storage space 42*a*. The storage space 42*a* is formed to straddle from the one rotor structural member 40*a* to the other rotor structural member 40*b*, while the center through-hole 42*b* is formed in the other rotor structural member 40*b* to pass therethrough in the axial direction ad. The center through-hole 42*b* also has a function as a working hole to be used when a cooling-fluid flow passage 60, which will be described below, is fabricated in the rotor structural members 40*a*, 40*b*.

An end of the center through-hole 42*b*, which is opposed to the storage space 42*a*, may be sealable by a cap, not shown. In this case, it can be prevented that the cooling fluid cf flows outside from the storage space 42*a* through the center through-hole 42*b*.

In addition, a supply passage 45 for supplying the cooling fluid cf to the storage space 42*a* is formed in the one rotor structural member 40*a*. The supply passage 45 communicates with a casing supply passage 25 formed in the casing 20, so that the cooling fluid cf is supplied from the casing supply passage 25 through a groove 26. Preferably, there are a plurality of the supply passages 45 and a plurality of the casing supply passages 25 which are arranged in the circumferential direction cd. This contributes to uniform supply of the cooling fluid cf to the storage space 42*a*.

In addition, a plurality of grand labyrinth seals 27 are provided between the rotor structural member 40*a* in which the supply passage 45 is formed, and an inner circumferential surface of the casing 20. The grand labyrinth seals 27 prevent leakage of the cooling fluid cf through a gap between the rotor structural member 40*a* and the casing 20.

Particularly in this embodiment, since the rotor structural member 40*a* in which the supply passage 45 is formed is not provided with the rotor wheels 46, the rotor structural member 40*a* is unlikely to be exposed to the working fluid wf of a high temperature. Thus, the rotor structural member 40*a* may be made of a relatively low heat-resistant material such as CrMoV steel.

On the other hand, the rotor structural member 40*b* in which the center through-hole 42*b* is formed is provided with the rotor wheels 46 to support the plurality of moving blade rows 50 rotated by the working fluid wf. Thus, the rotor structural member 40*b* is likely to be exposed to the working fluid wf of a high temperature, and may be made of a relatively high heat-resistant material such as a heat resistant steel like 12Cr steel or a heat resistant alloy like a Ni-based alloy.

As shown in FIG. 3, the cooling-fluid introducing passage 60 is formed in the rotor main body 41, which conducts the cooling fluid cf in the hollow part 42 to the working-fluid flow passage wp to cool the rotor wheels 46. The cooling-fluid introducing passage 60 in this embodiment is formed to extend from the hollow part 42 in a direction intersecting with the axial direction ad of the rotor main body 41, more specifically, along the radial direction rd perpendicular to the axial direction ad.

The cooling-fluid introducing passage 60 includes an inflow port 61 making a boundary between the cooling-fluid introducing passage 60 and the hollow part 42. The cooling fluid cf from the hollow part 42 enters the cooling-fluid introducing passage 60 through the inflow port 61. Further, the cooling-fluid introducing passage 60 includes an outflow port 62 provided on an outer circumferential surface of the rotor main body 41. The cooling fluid cf from the inflow port 61 is ejected from the outflow port 62 toward the working-fluid flow passage wp.

Figure 4:
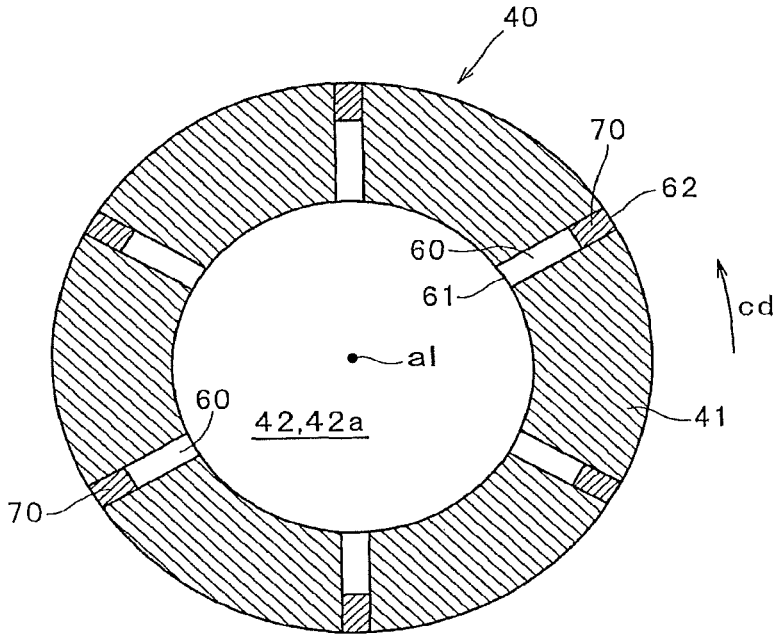
FIG. 4 is a sectional view showing a section of a rotor main body along the line IV-IV shown in FIG. 3.

FIG. 4 shows a section of the rotor main body 41 perpendicular to the axial direction ad of the rotor main body 41. As shown in FIG. 4, in the section of the rotor main body 41 perpendicular to the axial direction ad thereof, a plurality of the cooling-fluid introducing passages 60 are radially disposed about the axis al. Namely, the plurality of cooling-fluid introducing passages 60 are arranged along the circumferential direction of the rotor main body 41, and each cooling-fluid introducing passage 60 extends linearly along the radial direction rd. A plurality of rows, each of which includes the plurality of cooling-fluid introducing passages 60 arranged in the circumferential direction cd, are arranged along the axial direction ad.

The cooling fluid cf having flowed through the respective cooling-fluid introducing passages 60 flows around the rotor wheel 46 and/or between the two adjacent rotor wheels 46 so as to be conducted to the working-fluid flow passage wp. In the example shown in FIG. 3, the cooling fluid cf having flowed through the respective cooling-fluid introducing passage 60 flows into the working-fluid flow passage wp by way of one of the following three routes. A first route is a main flow passage 65 which passes through between the diaphragm inner ring 22 and the rotor wheel 46 along the radial direction rd and then passes through the upstream side of the moving blade 51. A second route is a second branch passage 66 which branches from the main flow passage 65 toward the downstream of the blade 51 and then passes through the downstream side of the moving blade 51. A third route is a third branch passage 67 which branches from the main flow passage 65 toward the downstream of the blade 51 and then flows toward the labyrinth seal device 23 supported by the diaphragm inner ring 22 located on the downstream.

In addition, in the example shown in FIG. 3, one cooling-fluid introducing passage 60 is provided correspondingly to one turbine stage 11. It should be pointed out that the temperature of the working fluid wf for rotating the moving blade rows 50 is the highest when it flows through the first turbine stage 11, and that the temperature gradually decreases as the working fluid wf flows through the turbine stages 11 located on the downstream side. Thus, the turbine stage(s) 11 located on the upstream side is (are) provided with one cooling-fluid introducing passage 60 to with respect to each turbine stage, while the turbine stage(s) located on the downstream side is (are) not provided with the cooling-fluid introducing passage 60.

As described above, the more upstream side the turbine stage 11 is located on, the more the turbine stage 11 is likely to be heated because of the higher temperature of the working fluid wf. Thus, the more upstream side the rotor wheel 46 is located on, the more the rotor wheel 46 is likely to have a high temperature so that a strength thereof is likely to lower. From this point of view, a flow rate of the cooling fluid cf for cooling the rotor wheel 46 is required to be controlled depending on a position of the rotor wheel 46. Thus, in this embodiment, a flow-rate control plug 70 is disposed in the cooling-fluid introducing passage 60.

Figure 5:
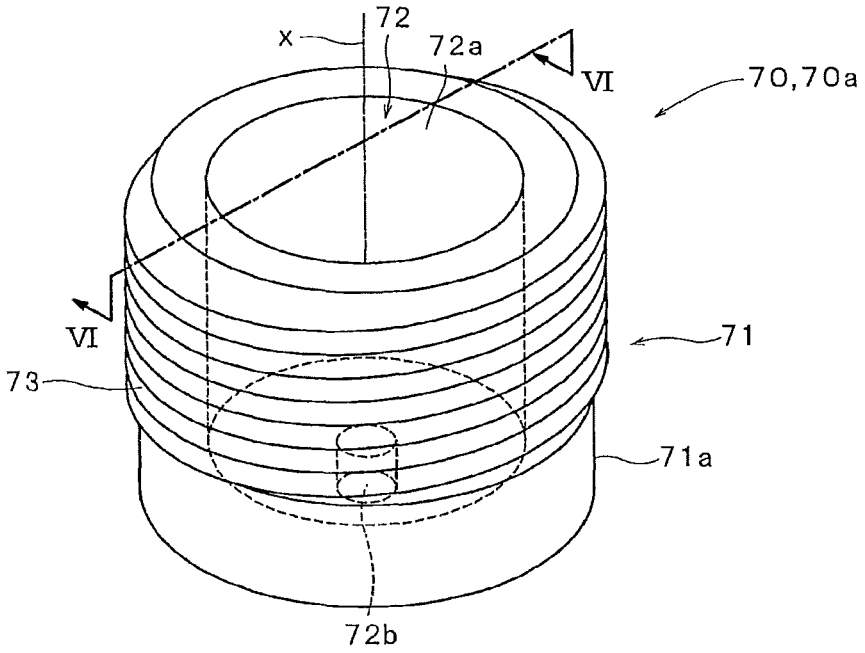
FIG. 5 is a perspective view showing an example of a flow-rate control plug disposed in a cooling-fluid introducing passage shown in FIG. 2.
Figure 6:
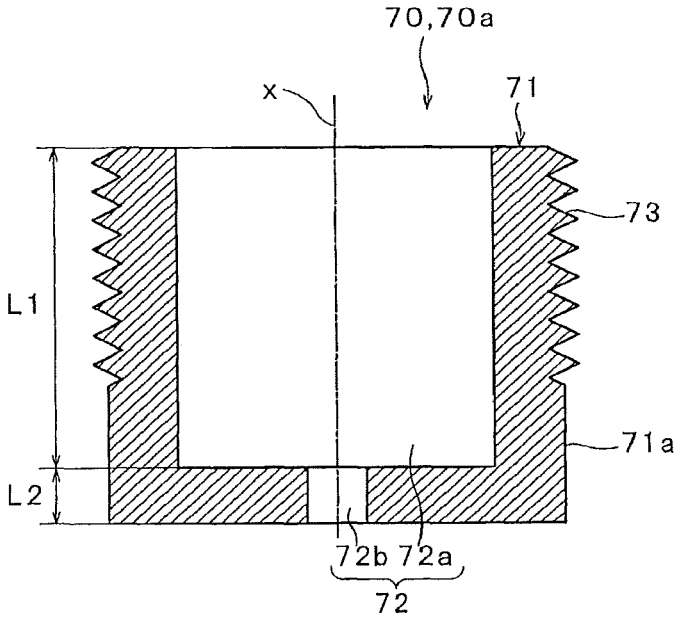
FIG. 6 is a sectional view of the flow-rate control plug along the line VI-VI shown in FIG. 5.

The flow-rate control plug 70 is configured to regulate a flow rate of the cooling fluid cf flowing through the cooling-fluid introducing passage 60. FIGS. 5 and 6 are a perspective view of the flow-rate control plug 70 and a sectional view thereof.

As shown in FIGS. 5 and 6, the flow-rate control plug 70 includes a cylindrical body 71 having a through-hole 72 through which the cooling fluid cf in the hollow part 42 flows. The through-hole 72 passes through the cylindrical body 71 in an axial direction X of the cylindrical body 71. In particular, the through-hole 72 includes a large diameter hole 72*a* and a small diameter hole 72*b* having a diameter smaller than a diameter of the large diameter hole 72*a*. Since the through-hole 72 includes the small diameter hole 72*b* having a diameter smaller than the diameter of the large diameter hole 72*a*, a regulating degree of a flow rate of the cooling fluid cf flowing through the flow-rate control plug 70 can be elevated.

In this embodiment, a length L2 of the small diameter hole 72*b* along the axial direction of the cylindrical body 71 is shorter than a length L1 of the large diameter hole 72*a* along the axial direction of the cylindrical body 71. Since the rotor wheel 46 located on the upstream side is more likely to have a high temperature, the length L2 of the small diameter hole 72*b* and the length L1 of the large diameter hole 72*a* can be suitably changed depending on a position at which the flow-rate control plug 70 is located. Typically, the more upstream side the rotor wheel 46 is located on, the more the rotor wheel 46 is likely to have a high temperature, whereby such a rotor wheel 46 is required to be intensively cooled. Thus, the more upstream side the flow-rate control plug 70 is located on, the shorter length L2 the small diameter hole 72 preferably has.

Similarly, since a pressure of the working fluid wf increases toward the upstream side, the more upstream side the cooling-fluid introducing passage 60 is located on, the larger pressure of the working fluid wf the cooling-fluid introducing passage is subjected to so that the cooling fluid cf is pushed back. Also for this reason, the more upstream side the flow-rate control plug 70 is located on, the shorter length L2 the small diameter hole 72*b* preferably has, in order to ensure a large pressure of the cooing fluid cf flowing through the flow-rate control plug 70.

A screw portion 73 is provided on an outer surface 71*a* of the cylindrical body 71. The screw portion 73 is screwed to a screw portion 43 (see FIG. 7) provided on a wall surface of the rotor main body 41 defining the cooling-fluid introducing passage 60. In this embodiment, the screw portion 73 of the cylindrical body 71 is formed as an external screw, and the screw portion 43 of the rotor main body 41 is formed as an internal screw. Particularly in the example shown in FIGS. 5 and 6, the screw portion 73 is provided on a portion of the outer surface 71*a* of the cylindrical body 71 surrounding the large diameter hole 72*a*, while no screw portion 73 is provided on a portion of the outer surface 71*a* of the cylindrical body 71 surrounding the small diameter hole 72*b*.

Although the flow-rate control plug 70 shown in FIG. 4 has a hollow cylindrical shape, the present invention is not limited to this example. The flow-rate control plug 70 may have any shape as long as the shape corresponds to the shape of the cooling-fluid introducing passage 60.

Next, an operation of the embodiment as structured above is described.

As shown in FIG. 2, when the working fluid wf supplied from the combustor 3 flows into the turbine 10, the turbine 10 is operated. During this operation, the working fluid wf flows into the first turbine stage 11 to pass sequentially through the respective turbine stages 11, and works for the respective moving blade 51 to rotate the turbine rotor 40 in rotation. Thereafter, the working fluid wf flows through the final turbine stage 11, and is discharged from the turbine 10 so as to be supplied to the regenerative heat exchanger 5.

With the inflow of the working fluid wf, the moving blade rows 50 and the rotor wheels 46 supporting the moving blade rows 50 are heated to have a higher temperature. In order to cool the rotor wheels 46, a regenerative gas discharged from the regenerative heat exchanger 5 is supplied as the cooling fluid cf from the casing supply passage 25 into the hollow part 42.

In this embodiment, a pressure of the hollow part 42 is higher than a pressure of the working fluid wf flowing through the working-fluid flow passage wp. Thus, the cooling fluid cf having been supplied to the hollow part 42 flows toward the working-fluid flow passage wp through the cooling-fluid introducing passage 60.

Figure 7:
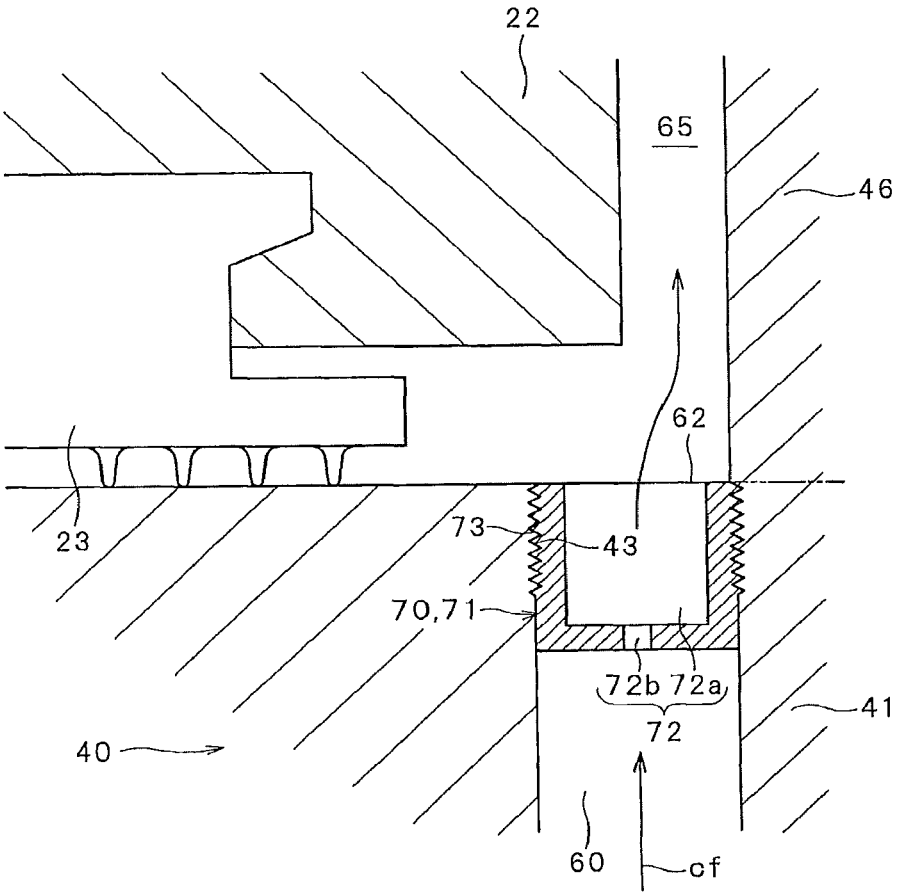
FIG. 7 is a longitudinal sectional view showing a condition in which a cooling fluid flows through the flow-rate control plug disposed in the cooling-fluid introducing passage shown in FIG. 3.

FIG. 7 shows a condition in which the cooling fluid cf flows through the flow-rate control plug 70 disposed in the cooling-fluid introducing passage 60. As shown in FIG. 7, since the small diameter hole 72*b* having a relatively smaller diameter is formed in the flow-rate control plug 70, the cooling fluid cf from the hollow part 42 flows toward the working-fluid flow passage wp, after the flow rate of the cooling fluid cf has been controlled in the flow-rate control plug 70.

The cooling fluid cf, which flows from each cooling-fluid introducing passage 60 toward the working-fluid flow passage wp, flows around the rotor wheel 46 and/or between the two adjacent rotor wheels 46 so as to be conducted to the working-fluid flow passage wp. Thus, the rotor wheel(s) 46 is (are) cooled by the cooling fluid cf.

The temperature of the cooling fluid cf may be set as a temperature at which a large thermal stress is not generated in the rotor wheel 46 to be cooled. In a steam turbine, the temperature of the cooling fluid cf may be set at about 400° C., although it largely depends on a specification of the turbine.

The cooing fluid cf having been guided to the working-fluid flow passage wp is mixed with the working fluid wf.

As can be seen from above, according to this embodiment, the turbine includes: the turbine main body 41 including the hollow part 42 into which the cooling fluid cf flows, and the plurality of rotor wheels 46 arranged in the axial direction ad of the rotor main body 41 and protruding from the rotor main body 41; and the plurality of moving blade rows 50 each being supported on the corresponding rotor wheel 46, the moving blade row 50 being driven by the working fluid wf flowing through the working-fluid flow passage wp; wherein the cooling-fluid introducing passage 60 extending from the hollow part 42 in a direction intersecting with the axial direction ad of the rotor main body 41 is formed in the rotor main body 41 so as to allow the cooling fluid cf in the hollow part 42 to flow through the cooling-fluid introducing passage 60 and then to flow around the rotor wheel 46 to be conducted to the working-fluid flow passage wp, and the flow-rate control plug 70 regulating the flow rate of the cooling fluid cf flowing through the cooling-fluid introducing passage 60 is disposed in the cooling-fluid introducing passage 60.

According to such an embodiment, by disposing the flow-rate control plug 70 in the cooling-fluid introducing passage 60, the flow rate of the cooling fluid cf flowing through the cooling-fluid introducing passage 60 can be easily controlled to be minimum. As a result, lowering of the temperature of the working fluid wf, which is caused by the cooling fluid cf merging with the working fluid wf, can be restrained as much as possible, whereby lowering of the turbine efficiency can be easily restrained.

In addition, according to this embodiment, the flow-rate control plug 70 has the cylindrical body 71 including the through-hole 72 through which the cooling fluid cf in the hollow part 42 flows, the through-hole 72 includes the large diameter hole 72*a* and the small diameter hole 72*b* having a diameter smaller than a diameter of the large diameter hole 72*a*, the screw portion 73 screwed to the screw portion 43 provided on the wall surface of the rotor main body 41 defiling the cooling-fluid introducing passage 60 is provided on the outer surface 71*a* of the cylindrical body 71. According to such an embodiment, since the through-hole 72 includes the small diameter hole 72*b* having a diameter smaller than the diameter of the large diameter hole 72*a*, a regulating degree of a flow rate of the cooling fluid cf flowing through the flow-rate control plug 70 can be elevated. In addition, by screwing the screw portion 73 provided on the outer surface 71*a* of the cylindrical body 71 to the screw portion 43 of the rotor main body 41, the flow-rate control plug 70 can be easily disposed in the cooling-fluid introducing passage 60.

In addition, according to this embodiment, the length L2 of the small diameter hole 72*b* along the axial direction X of the cylindrical body 71 is shorter than the length L1 of the large diameter hole 72*a* along the axial direction X of the cylindrical body 71. In this case, it is possible to make the cooling fluid cf flow through the flow-rate control plug 70 at a sufficient flow rate, while sufficiently ensuring the function of the small diameter hole 72*b* for regulating a flow rate of the cooling fluid cf flowing through the flow-rate control plug 70.

In addition, according to this embodiment, the turbine rotor 40 is composed of two rotor structural members 40*a*, 40*b* connected to each other by welding, the hollow part 42 is formed by the two rotor structural members 40*a*, 40*b*, and the hollow part 42 includes the center through-hole 42*b* passing through one of the two rotor structural members 40*a*, 40*b* along the axial direction ad. In this case, by using the center through-hole 42*b* as a working hole, the cooling-fluid introducing passages 60 can be easily fabricated in the rotor structural members 40*a*, 40*b*.

In addition, according to this embodiment, the supply passage 45 for supplying the cooling fluid cf to the hollow part 42 is formed in the upstream rotor structural member 40*a* of the two rotor structural members 40*a*, 40*b*. Since the supply passage 45 supplies the cooing fluid cf at a high pressure to the hollow part 42, the cooling fluid cf, which has been heated by heat exchange with the rotor wheels 46, and the working fluid wf for rotating the moving blade rows 50 rarely flow back to the upstream rotor structural member 40*a*. As a result, the upstream rotor structural member 40*a* is unlikely to be heated by the heated cooling fluid cf and/or the working fluid wf. Thus, even if the upstream rotor structural member 40*a* is made of a low heat-resistant material, deterioration by heat can be restrained.

In addition, according to this embodiment, the plurality of cooling-fluid introducing passages 60 have the same diameter. The more upstream side the flow-rate control plug 70 is located on, the shorter length L2 the small diameter hole 72*b* has. In this case, only by changing the length L2 of the small diameter hole 72*b* of the flow-rate control plug 70 depending on a position at which the flow-rate control plug 70 is located, it is possible to surely cool the rotor wheels 46 located on the upstream side where they are likely to be heated to a high temperature. Namely, according to such an embodiment, positioning of the flow-rate control plugs 70 for optimally cooling the rotor wheels 46 can be easily achieved.

As shown in FIG. 3, in the turbine 10 according to this embodiment, the plurality of cooling-fluid introducing passages 60 are arranged in the axial direction ad of the rotor main body 41, each cooling-fluid introducing passage 60 includes an inflow port 61 making a boundary between the cooling-fluid introducing passage 60 and the hollow part 42, and a distance between the inflow port 61 of at least one of the cooling-fluid introducing passages 60 and the axis al of the rotor main body 41 is equal to a distance between the inflow port 61 of at least one of the other cooling-fluid introducing passage 60 and the axis at of the rotor main body 41. Specifically, a distance between the respective inflow port 61 making the boundary between the cooling-fluid introducing passage 60 and the hollow part 42, and the axis at of the rotor main body 41 is equal to a distance between another optional inflow port 61 making the boundary between the cooling-fluid introducing passage 60 and the hollow part 42, and the axis at of the rotor main body 41. In addition, a distance between the respective inflow part 61 making a boundary between the cooling-fluid introducing passage 60 and the center through-hole 42*b*, and the axis at of the rotor main body 41 is equal to a distance between another optional inflow port 61 making the boundary between the cooling-fluid introducing passage 60 and the center through-hole 42, and the axis al of the rotor main body 41.

Modification Example

In the aforementioned embodiment, as shown in FIG. 1, the combustor 3 for generating a combustion gas as a working fluid to be supplied to the turbine 10 generates a combustion gas, by combusting oxygen supplied from the oxygen producing apparatus 2 and a fuel. However, not limited to this example, the combustor 3 may generate a combustion gas by combusting air and fuel. In addition, not limited to the power plant 1 shown in FIG. 1, the turbine 10 in the aforementioned embodiment can be applied to a power plant of another optional structure.

Figure 8:
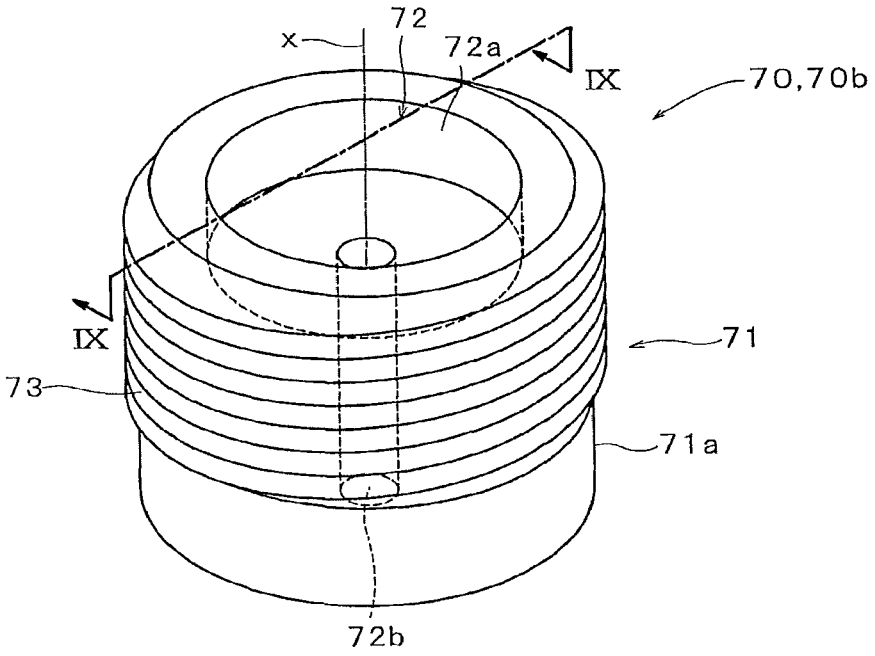
FIG. 8 is a perspective view showing another example of the flow-rate control plug shown in FIG. 5.
Figure 9:
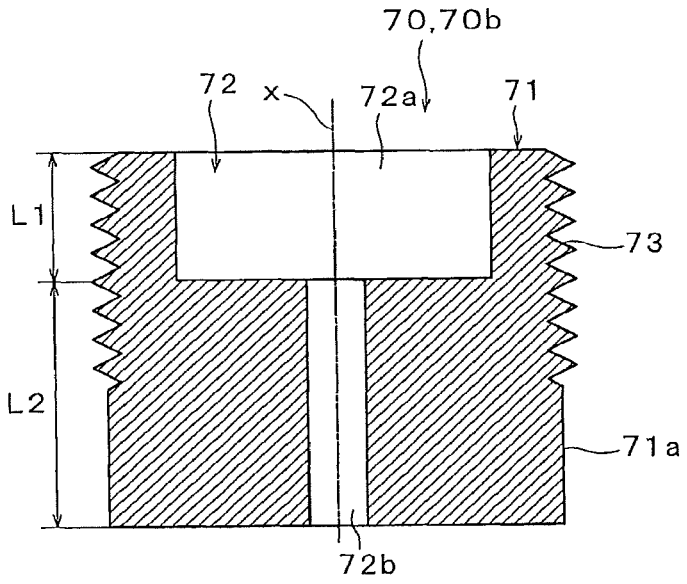
FIG. 9 is a sectional view of the flow-rate control plug along the line IX-IX shown in FIG. 8.

In addition, in the aforementioned embodiment, as shown in FIG. 6, the flow-rate control plug 70 is formed of an orifice type flow-rate control plug 70*a* in which the length L2 of the small diameter hole 72*b* is shorter than the length L1 of the large diameter hole 72*a*. However, the shape of the flow-rate control plug 70 is not limited to the above example. FIGS. 8 and 9 show another example of the flow-rate control plug 70, and FIG. 10 shows yet another example of the flow-rate control plug 70.

In the example shown in FIGS. 8 and 9, the flow-rate control plug 70 is formed of a narrow tube type flow-rate control plug 70*b* in which the length L2 of the small diameter hole 72*b* along the axial direction X of the cylindrical body 71 is longer than the length L1 of the large diameter hole 72*a* along the axial direction X of the cylindrical body 71. The screw portion 73 provided on the outer surface 71*a* of the cylindrical body 71 extends over both a part of the outer surface 71*a* of the cylindrical body 71 surrounding the large diameter hole 72*a*, and a part of the outer surface 71*a* of the cylindrical body 71 surrounding the small diameter hole 72*b*. According to the narrow tube type flow-rate control plug 70*b*, the function of the small diameter hole 72*b* for regulating a flow rate of the cooling fluid cf flowing through the flow-rate control plug 70 can be more reliably ensured.

Figure 10:
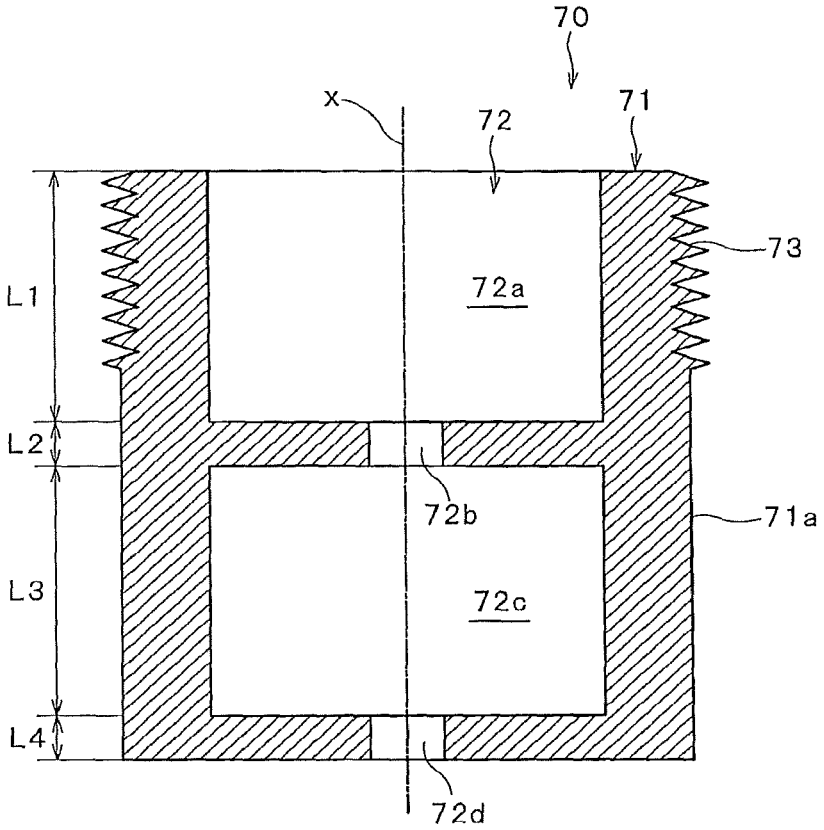
FIG. 10 is a sectional view showing another example of the flow-rate control plug shown in FIG. 5.

In the example shown in FIG. 10, the through-hole 72 formed in the cylindrical body 71 constituting the flow-rate control plug 70 further includes an additional large diameter hole 72*c* having a diameter larger than the diameter of the small diameter hole 72*b*, and an additional small diameter hole 72*d* having a diameter smaller than the diameters of the additional large diameter hole 72*c* and the large diameter hole 72*a*. The large diameter hole, the small diameter hole 72*b*, the additional large diameter hole 72*c* and the additional small diameter hole 72*d* are arranged in this order.

In particular, the length L2 of the small diameter hole 72*b* along the axial direction X of the cylindrical body 71 and a length L4 of the additional small diameter hole 72*d* along the axial direction X of the cylindrical body 71 are shorter than the length L1 of the large diameter hole 72*a* along the axial direction X of the cylindrical body 71 and a length L3 of the additional large diameter hole 72*c* of the axial direction X of the cylindrical body 71.

In addition, in the example shown in FIG. 10, the screw portion 73 provided on the outer surface 71*a* of the cylindrical body 71 is disposed on a portion of the outer surface 71*a* of the cylindrical body 71 surrounding the large diameter hole 72*a*, while no screw portion 73 is disposed on a portion of the outer surface 71*a* of the cylindrical body 71 surrounding the small diameter hole 72*b*, the additional large diameter hole 72*c* and the additional small diameter hole 72*d*.

According to the flow-rate control plug 70 shown in FIG. 10, since the large diameter hole 72*a*, the small diameter hole 72*b*, the additional large diameter hole 72*c* and the additional small diameter hole 72*d* are arranged in this order, by utilizing an abrupt enlargement loss and an abrupt contraction loss, it is possible to more strictly regulate the flow rate of the cooling fluid cf flowing through the flow-rate control plug 70.

Figure 11:
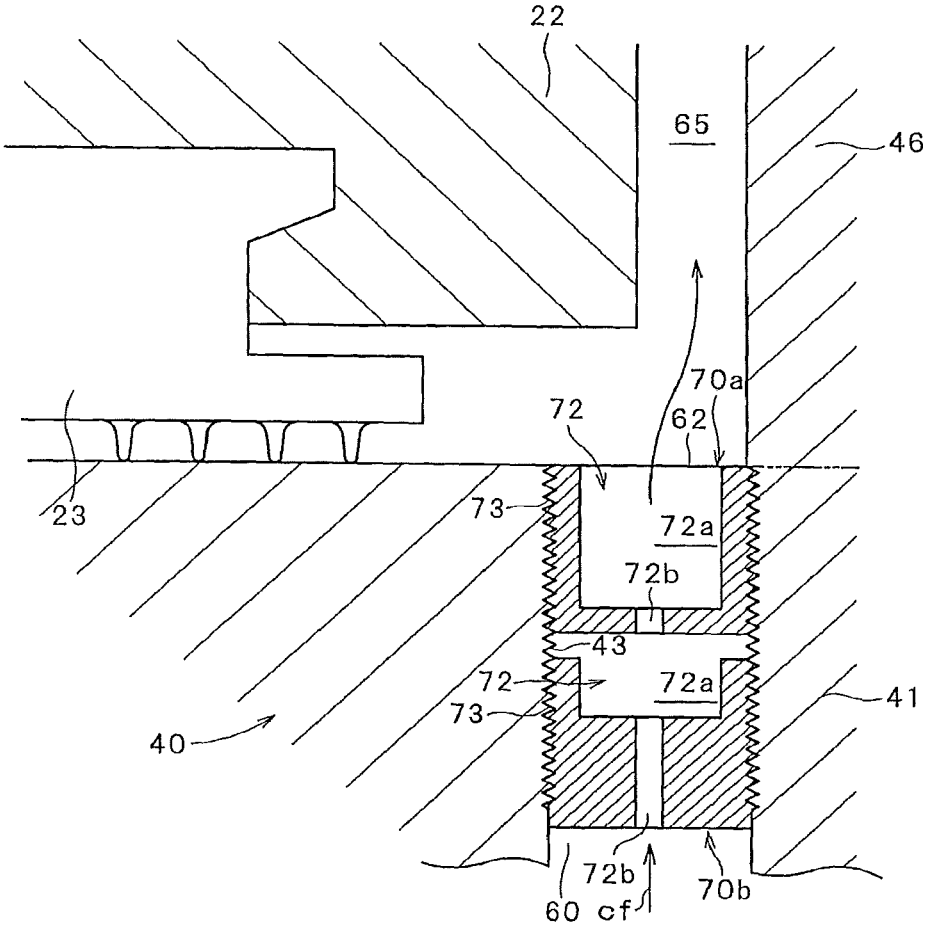
FIG. 11 is a longitudinal sectional view showing another example in which the flow-rate control plug is disposed in the cooling-fluid introducing passage shown in FIG. 8.

In addition, in the aforementioned embodiment, as shown in FIG. 7, one cooling-fluid introducing passage 60 is equipped with one flow-rate control plug 70. However, the number of cooling-fluid control plug(s) 70 disposed in the cooling-fluid introducing passage 60 is not limited to the above example. FIG. 11 shows an example in which a plurality of the flow-rate control plugs 70 are disposed in one cooling-fluid introducing passage 60.

In the example shown in FIG. 11, the orifice type flow-rate control plug 70*a* shown in FIG. 5 and the narrow tube type flow-rate control plug 70*b* shown in FIG. 8 are disposed in one cooling-fluid introducing passage 60. The screw portion 73 of the orifice type flow-rate control plug 70*a* and the screw portion 73 of the narrow tube type flow-rate control plug 70*b* are screwed to one screw portion 43 of the rotor main body 41.

According to the embodiment shown in FIG. 11, the first flow-rate control plug 70*a* and the second flow-rate control plug 70*b* are disposed in one cooling-fluid introducing passage 60, in the first flow-rate control plug 70*a*, the length L2 of the small diameter hole 72*b* along the axial direction X of the cylindrical body 71 is shorter than the length L1 of the large diameter hole 72*a* along the axial direction X of the cylindrical body 71, and, in the second flow-rate control plug 70*b*, the length L2 of the small diameter hole 72*b* along the axial length X of the cylindrical body 71 is longer than the length L1 of the large diameter hole 72*a* along the axial direction X of the cylindrical body 71. According to such an embodiment, since the flow rate of the cooling fluid cf flowing through the one cooling-fluid introducing passage 60 can be controlled with a still higher degree of freedom, the optimum flow rate control can be achieved more minutely.

Figure 12:
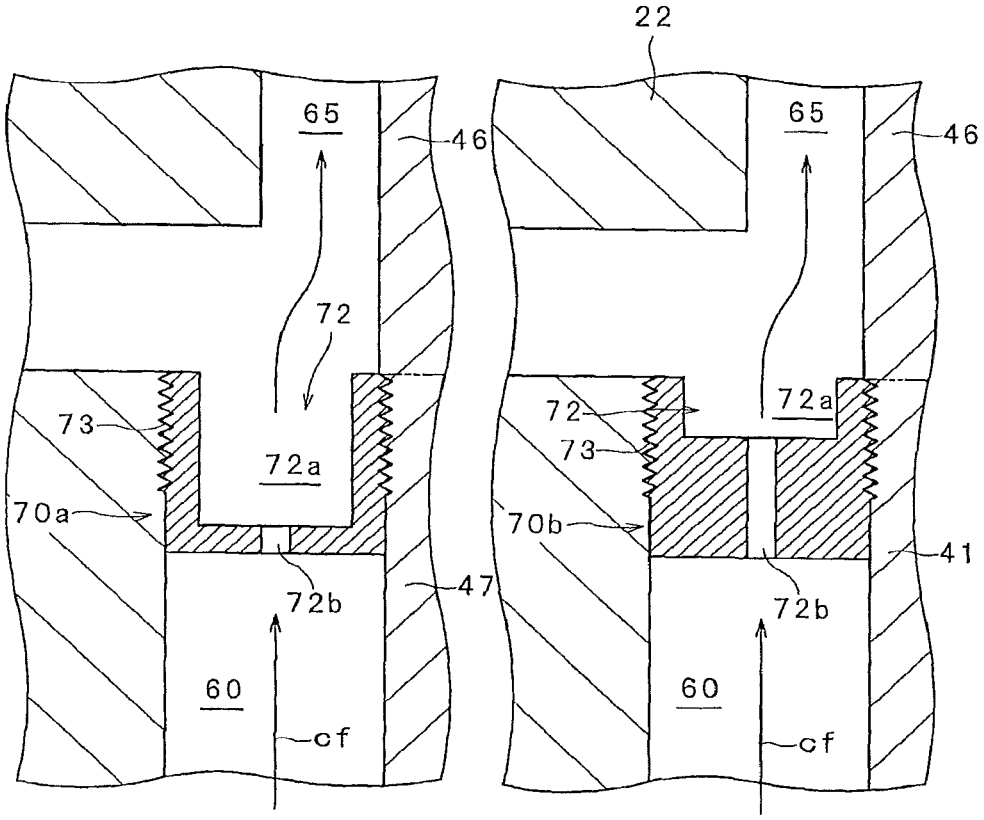
FIG. 12 is a longitudinal sectional view showing yet another example in which the flow-rate control plug is disposed in the cooling-fluid introducing passage shown in FIG. 8.

In addition, in the aforementioned embodiment, the more upstream side the flow-rate control plug 70 is located on, the shorter length L2 the small diameter hole 72 has. However, the positioning of the flow-rate control plugs 70 is not limited to the above example. FIG. 12 shows another positioning example of the flow-rate control plugs 70.

Also in the example shown in FIG. 12, the more upstream side the flow-rate control plug 70 is located on, the less it regulates the flow rate of the cooling fluid cf flowing through the flow-rate control plug 70. To be specific, the flow-rate control plug 70 located on the upstream side is formed of the orifice type flow-rate control plug 70*a* which less regulates the flow rate of the cooling fluid cf, and the flow-rate control plug 70 located on the downstream side is formed of the narrow tube type flow-rate control plug 70*b* which more regulates the flow rate of the cooling fluid cf.

According to the embodiment shown in FIG. 12, the first flow-rate control plug 70*a* is disposed in a first cooling-introducing passage 60, and in the first flow-rate control plug 70*a*, the length L2 of the small diameter hole 72*b* along the axial direction X of the cylindrical body 71 is shorter than the length L1 of the large diameter hole 72*a* along the axial direction X of the cylindrical body 71, and the second flow-rate control plug 70*b* is disposed in a second cooling-fluid introducing passage 60, and in the second flow-rate control plug 70*b*, the length L2 of the small diameter hole 72*b* along the axial direction X of the cylindrical body 71 is longer than the length L1 of the large diameter bole 72*a* along the axial direction of the cylindrical body 71. According to such an embodiment, by combining the different types of flow-rate control plugs 70*a*, 70*b*, the optimum flow rate control of the cooling fluid cf depending on the positions of the flow-rate control plugs 70*a*, 70*b* can be achieved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Further, it will be understood that these embodiments can be at least partially combined properly without departing from the spirit of the present invention.

The invention claimed is:

1. A turbine comprising:

a turbine rotor having a rotor main body including a hollow part into which a cooling fluid flows, and a plurality of rotor wheels arranged in an axial direction of the rotor main body and protruding from the rotor main body; and a plurality of moving blade rows each being supported on the corresponding rotor wheel, the moving blade rows being driven by a working fluid flowing through a working-fluid flow passage, wherein a cooling-fluid introducing passage extending from the hollow part in a direction intersecting with the axial direction of the rotor main body is formed in the rotor main body so as to allow the cooling fluid in the hollow part to flow through the cooling-fluid introducing passage and then to flow around the rotor wheels to be conducted to the working-fluid flow passage, and a flow-rate control plug regulating a flow rate of the cooling fluid flowing through the cooling-fluid introducing passage is disposed in the cooling-fluid introducing passage, the flow-rate control plug has a cylindrical body including a through-hole through which the cooling fluid in the hollow part flows, the through-hole includes a large diameter hole and a small diameter hole having a diameter smaller than a diameter of the large diameter hole, and a screw portion screwed to a screw portion provided on the wall surface of the rotor main body defining the cooling-fluid introducing passage is provided on an outer surface of the cylindrical body.

2. The turbine according to claim 1, wherein a length of the small diameter hole along the axial direction of the cylindrical body is shorter than a length of the large diameter hole along the axial direction of the cylindrical body.

3. The turbine according to claim 1, wherein a length of the small diameter hole along the axial direction of the cylindrical body is longer than a length of the large diameter hole along the axial direction of the cylindrical body.

4. The turbine according to claim 1, wherein the through-hole formed in the cylindrical body includes an additional large diameter hole having a diameter larger than the diameter of the small diameter hole, and an additional small diameter hole having a diameter smaller than the diameters of the additional large diameter hole and the large diameter hole, and the large diameter hole, the small diameter hole, the additional large diameter hole and the additional small diameter hole are arranged in this order.

5. The turbine according to claim 1, wherein a first flow-rate control plug and a second flow-rate control plug are disposed in one cooling-fluid introducing passage, in the first flow-rate control plug, a length of the small diameter hole along the axial direction of the cylindrical body is shorter than a length of the large diameter hole along the axial direction of the cylindrical body, and, in the second flow-rate control plug, a length of the small diameter hole along the axial direction of the cylindrical body is longer than a length of the large diameter hole along the axial direction of the cylindrical body.

6. The turbine according to claim 1, wherein a first flow-rate control plug is disposed in a first cooling-fluid introducing passage, and in the first flow-rate control plug, a length of the small diameter hole along the axial direction of the cylindrical body is shorter than a length of the large diameter hole along the axial direction of the cylindrical body, and a second flow-rate control plug is disposed in a second cooling-fluid introducing passage, and in the second flow-rate control plug, a length of the small diameter hole along the axial direction of the cylindrical body is longer than a length of the large diameter hole along the axial direction of the cylindrical body.

7. The turbine according to claim 1, wherein a plurality of the cooling-fluid introducing passages are arranged in the axial direction of the rotor main body, each cooling-fluid introducing passage includes an inflow port making a boundary between the cooling-fluid introducing passage and the hollow part, and a distance between the inflow port of at least one of the cooling-fluid introducing passages and the axis of the rotor main body is equal to a distance between the inflow port of at least one of the other cooling-fluid introducing passages and the axis of the rotor main body.

8. The turbine according to claim 1, wherein the turbine rotor is composed of two rotor structural members connected to each other by welding, the hollow part is formed by the two rotor structural members, and the hollow part includes a center through-hole passing through one of the two rotor structural members along the axial direction.

9. The turbine according to claim 8, wherein one of the two rotor structural members has a heat resistance greater than a heat resistance of the other rotor structural member, and a supply passage supplying the cooling fluid to the hollow part is formed in said other rotor structural member.

* * * * *